US008958586B2

(12) United States Patent
Preves

(10) Patent No.: US 8,958,586 B2
(45) Date of Patent: Feb. 17, 2015

(54) SOUND ENVIRONMENT CLASSIFICATION BY COORDINATED SENSING USING HEARING ASSISTANCE DEVICES

(71) Applicant: Starkey Laboratories, Inc., Eden Prairie, MN (US)

(72) Inventor: David A. Preves, Bradenton, FL (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 13/725,579

(22) Filed: Dec. 21, 2012

(65) Prior Publication Data

US 2014/0177894 A1 Jun. 26, 2014

(51) Int. Cl.
*H04R 25/00* (2006.01)

(52) U.S. Cl.
CPC ..... *H04R 25/00* (2013.01); *H04R 25/407* (2013.01); *H04R 25/505* (2013.01); *H04R 2225/41* (2013.01)
USPC ..... 381/312; 381/23.1; 381/313; 381/317; 381/320; 381/321

(58) Field of Classification Search
CPC ..... H04R 2225/41
USPC ..... 381/312, 317, 23.1, 313, 320, 321
See application file for complete search history.

(56) References Cited

U.S. PATENT DOCUMENTS 5,604,812 A 2/1997 Meyer
6,389,142 B1 5/2002 Hagen et al.
6,522,756 B1 2/2003 Maisano et al.
6,718,301 B1 4/2004 Woods
6,782,361 B1 8/2004 El-Maleh et al.
6,912,289 B2 6/2005 Vonlanthen et al.
7,020,296 B2 * 3/2006 Niederdrank ..... 381/315
7,149,320 B2 12/2006 Haykin et al.
7,158,931 B2 1/2007 Allegro
7,349,549 B2 3/2008 Bachler et al.

(Continued)

FOREIGN PATENT DOCUMENTS

AU 2005100274 A4 6/2005
AU 2002224722 B2 4/2008

(Continued)

OTHER PUBLICATIONS

"U.S. Appl. No. 11/276,793, Advisory Action mailed Jan. 6, 2012", 3 pgs.

(Continued)

*Primary Examiner* — Curtis Kuntz
*Assistant Examiner* — Ryan Robinson
(74) *Attorney, Agent, or Firm* — Schwegman Lundberg & Woessner, P.A.

(57) ABSTRACT

Techniques are disclosed for classifying a sound environment for hearing assistance devices using redundant estimates of an acoustical environment from two hearing assistance devices and accessory devices. In one example, a method for operating a hearing assistance device includes sensing an environmental sound, determining a first classification of the environmental sound, receiving at least one second classification of the environmental sound, comparing the determined first classification and the at least one received second classification, and selecting an operational classification for the hearing assistance device based upon the comparison.

18 Claims, 5 Drawing Sheets

(56) References Cited

U.S. PATENT DOCUMENTS

| | | | | |
|---|---|---|---|---|
| 7,383,178 | B2 | 6/2008 | Visser et al. | |
| 7,454,331 | B2 | 11/2008 | Vinton et al. | |
| 7,773,763 | B2 * | 8/2010 | Pedersen | 381/321 |
| 7,986,790 | B2 | 7/2011 | Zhang et al. | |
| 8,027,495 | B2 * | 9/2011 | Roeck | 381/312 |
| 8,068,627 | B2 | 11/2011 | Zhang et al. | |
| 8,143,620 | B1 | 3/2012 | Malinowski et al. | |
| 8,249,284 | B2 * | 8/2012 | Allegro-Baumann et al. | 381/309 |
| 8,477,972 | B2 * | 7/2013 | Buhmann et al. | 381/312 |
| 8,494,193 | B2 | 7/2013 | Zhang et al. | |
| 2002/0012438 | A1 | 1/2002 | Leysieffer et al. | |
| 2002/0039426 | A1 | 4/2002 | Takemoto et al. | |
| 2002/0191799 | A1 | 12/2002 | Nordqvist et al. | |
| 2002/0191804 | A1 | 12/2002 | Luo et al. | |
| 2003/0112988 | A1 | 6/2003 | Naylor | |
| 2003/0144838 | A1 | 7/2003 | Allegro | |
| 2004/0015352 | A1 | 1/2004 | Ramakrishnan et al. | |
| 2004/0190739 | A1 | 9/2004 | Bachler et al. | |
| 2005/0069162 | A1 | 3/2005 | Haykin et al. | |
| 2005/0129262 | A1 | 6/2005 | Dillon et al. | |
| 2006/0215860 | A1 | 9/2006 | Wyrsch | |
| 2007/0116308 | A1 | 5/2007 | Zurek et al. | |
| 2007/0117510 | A1 | 5/2007 | Elixmann | |
| 2007/0217620 | A1 | 9/2007 | Zhang et al. | |
| 2007/0217629 | A1 | 9/2007 | Zhang et al. | |
| 2007/0219784 | A1 | 9/2007 | Zhang et al. | |
| 2007/0223753 | A1 | 9/2007 | Latzel | |
| 2007/0269065 | A1 | 11/2007 | Kilsgaard | |
| 2007/0299671 | A1 | 12/2007 | McLachlan et al. | |
| 2008/0019547 | A1 | 1/2008 | Baechler | |
| 2008/0037798 | A1 | 2/2008 | Baechler et al. | |
| 2008/0107296 | A1 | 5/2008 | Bachler et al. | |
| 2008/0260190 | A1 | 10/2008 | Kidmose | |
| 2011/0137656 | A1 | 6/2011 | Xiang et al. | |
| 2012/0155664 | A1 | 6/2012 | Zhang et al. | |
| 2012/0213392 | A1 | 8/2012 | Zhang et al. | |

FOREIGN PATENT DOCUMENTS

| | | | |
|---|---|---|---|
| CA | 2439427 | A1 | 4/2002 |
| EP | 0396831 | A2 | 11/1990 |
| EP | 0335542 | B1 | 12/1994 |
| EP | 1256258 | B1 | 3/2005 |
| EP | 1841285 | A1 | 10/2007 |
| WO | WO-0176321 | A1 | 10/2001 |
| WO | WO-0232208 | A2 | 4/2002 |
| WO | WO-2008084116 | A2 | 7/2008 |

OTHER PUBLICATIONS

"U.S. Appl. No. 11/276,793, Final Office Action mailed Aug. 12, 2010", 27 pgs.
"U.S. Appl. No. 11/276,793, Final Office Action mailed Oct. 18, 2012", 31 pgs.
"U.S. Appl. No. 11/276,793, Final Office Action mailed Oct. 25, 2011", 29 pgs.
"U.S. Appl. No. 11/276,793, Non Final Office Action mailed Jan. 19, 2010", 23 pgs.
"U.S. Appl. No. 11/276,793, Non Final Office Action mailed Feb. 9, 2011", 25 pgs.
"U.S. Appl. No. 11/276,793, Non Final Office Action mailed Mar. 21, 2012", 28 pgs.
"U.S. Appl. No. 11/276,793, Non Final Office Action mailed May 12, 2009", 20 pgs.
"U.S. Appl. No. 11/276,793, Notice of Allowance mailed Mar. 21, 2013", 11 pgs.
"U.S. Appl. No. 11/276,793, Response filed Jan. 12, 2011 to Final Office Action mailed Aug. 12, 2010", 11 pgs.
"U.S. Appl. No. 11/276,793, Response filed Feb. 18, 2013 to Final Office Action mailed Oct. 18, 2012", 11 pgs.
"U.S. Appl. No. 11/276,793, Response filed Jun. 21, 2010 to Non Final Office Action mailed Jan. 19, 2010", 10 pgs.
"U.S. Appl. No. 11/276,793, Response filed Aug. 9, 2011 to Non Final Office Action mailed Feb. 9, 2011", 14 pgs.
"U.S. Appl. No. 11/276,793, Response filed Aug. 21, 2012 to Non Final Office Action mailed Mar. 21, 2012", 11 pgs.
"U.S. Appl. No. 11/276,793, Response filed Nov. 11, 2009 to Non Final Office Action mailed May 12, 2009", 16 pgs.
"U.S. Appl. No. 11/276,793, Response filed Dec. 27, 2011 to Final Office Action mailed Oct. 25, 2011", 12 pgs.
"U.S. Appl. No. 11/276,795, Advisory Action mailed Jan. 12, 2010", 13 pgs.
"U.S. Appl. No. 11/276,795, Decision on Pre-Appeal Brief Request mailed Apr. 14, 2010", 2 pgs.
"U.S. Appl. No. 11/276,795, Examiner Interview Summary mailed Feb. 9, 2011", 3 pgs.
"U.S. Appl. No. 11/276,795, Examiner Interview Summary mailed Mar. 11, 2011", 1 pg.
"U.S. Appl. No. 11/276,795, Final Office Action mailed Oct. 14, 2009", 15 pgs.
"U.S. Appl. No. 11/276,795, Final Office Action mailed Nov. 24, 2010", 17 pgs.
"U.S. Appl. No. 11/276,795, Non Final Office Action mailed May 7, 2009", 13 pgs.
"U.S. Appl. No. 11/276,795, Non Final Office Action mailed May 27, 2010", 14 pgs.
"U.S. Appl. No. 11/276,795, Notice of Allowance mailed Mar. 18, 2011", 12 pgs.
"U.S. Appl. No. 11/276,795, Pre-Appeal Brief Request mailed Feb. 16, 2010", 4 pgs.
"U.S. Appl. No. 11/276,795, Response filed Jan. 24, 2011 to Final Office Action mailed Nov. 24, 2010", 11 pgs.
"U.S. Appl. No. 11/276,795, Response filed Sep. 8, 2009 to Non Final Office Action mailed May 7, 2009", 10 pgs.
"U.S. Appl. No. 11/276,795, Response filed Sep. 28, 2010 to Non Final Office Action mailed May 27, 2010", 6 pgs.
"U.S. Appl. No. 11/276,795, Response filed Dec. 14, 2009 to Final Office Action mailed Oct. 14, 2009", 10 pgs.
"U.S. Appl. No. 11/686,275, Notice of Allowance mailed Aug. 31, 2011", 9 pgs.
"U.S. Appl. No. 11/686,275, Supplemental Notice of Allowability mailed Oct. 28, 2011", 3 pgs.
"U.S. Appl. No. 13/189,990, Final Office Action mailed May 22, 2013", 15 pgs.
"U.S. Appl. No. 13/189,990, Non Final Office Action mailed Nov. 26, 2012", 12 pgs.
"U.S. Appl. No. 13/189,990, Preliminary Amendment filed Mar. 5, 2012", 37 pgs.
"U.S. Appl. No. 13/189,990, Response filed Feb. 27, 2013 to Non Final Office Action mailed Nov. 26, 2012", 8 pgs.
"U.S. Appl. No. 13/304,825, Non Final Office Action mailed Mar. 26, 2013", 5 pgs.
"European Application Serial No. 07250920.1, Extended European Search Report mailed May 11, 2007", 6 pgs.
"European Application Serial No. 07250920.1, Office Action mailed Sep. 27, 2011", 5 pgs.
"European Application Serial No. 07250920.1, Response filed Feb. 1, 2012 to Office Action mailed Sep. 27, 2011", 15 pgs.
El-Maleh, Khaled Helmi, "Classification-Based Techniques for Digital Coding of Speech-plus-Noise", Department of Electrical & Computer Engineering, McGill University, Montreal, Canada, A thesis submitted to McGill University in partial fulfillment of the requirements for the degree of Doctor of Philosophy., (Jan. 2004), 152 pgs.
Preves, David A., "Field Trial Evaluations of a Switched Directional/Omnidirectional In-the-Ear Hearing Instrument", Journal of the American Academy of Audiology, 10(5), (May 1999), 273-283.
"European Application Serial No. 13198184.7, Extended European Search Report mailed Apr. 4, 2014", 5 pgs.

* cited by examiner

SOUND ENVIRONMENT CLASSIFICATION BY COORDINATED SENSING USING HEARING ASSISTANCE DEVICES

TECHNICAL FIELD

The disclosure relates generally to hearing assistance devices and, more particularly, to hearing assistance devices that utilize sound environment classification techniques.

BACKGROUND

Hearing aid users are typically exposed to a variety of sound environments, such as speech, music, or noisy environment. Various techniques are known and used to classify a user's sound environment, e.g., the Baynesian classifier, the Hidden Markov Model (HMM), and Gaussian Mixture Model (GMM). Based on the classified sound environment, the hearing assistance device can apply parameter settings appropriate for the sound environment to improve a user's listening experience.

Each of the known sound environment classification techniques, however, has less than 100% accuracy. As a result, the user's sound environment can be misclassified. This misclassification can result in parameter settings for the hearing assistance device that may not be optimal for the user's sound environment.

Accordingly, there is a need in the art for improved sound environment classification for hearing assistance devices.

SUMMARY

In general, this disclosure describes techniques for classifying a sound environment for hearing assistance devices using redundant estimates of an acoustical environment from two hearing assistance devices, e.g., left and right, accessory devices, and an on-the-body device, e.g., a microphone with a wireless transmitter, and/or an off-the-body device, e.g., a mobile communication device, such as a mobile phone or a microphone accessory, facilitated by a communication link, e.g., wireless, between the hearing assistance devices and the on-the-body device and/or the off-the-body device. Using various techniques of this disclosure, each device can determine a classification uncertainty value, which can be compared, e.g., using an error matrix and error distribution, in order to determine a consensus for environmental classification.

In one example, this disclosure is directed to a method of operating a hearing assistance device that includes sensing an environmental sound, determining a first classification of the environmental sound, receiving at least one second classification of the environmental sound, comparing the determined first classification and the at least one received second classification, and selecting an operational classification for the hearing assistance device based upon the comparison.

In another example, this disclosure is directed to a system that includes a first hearing assistance device that includes a microphone, a transceiver and a processor. The microphone is configured to sense an environmental sound and the transceiver is configured to receive at least one second classification of the environmental sound. The processor includes a classification module configured to determine a first classification of the sensed environmental sound, and a consensus determination module configured to compare the determined first classification and the at least one received second classification, and, when the determined classification is the same as the at least one received second classification, to select an operational classification for the hearing assistance device based upon the comparison. However, if, upon comparison, the received sound classification and the determined sound classification do not agree with one another, a binaural consensus between the two hearing assistance devices has not been reached and, in accordance with this disclosure, additional steps can be taken to resolve the disagreement.

This Summary is an overview of some of the teachings of the present application and not intended to be an exclusive or exhaustive treatment of the present subject matter. Further details about the present subject matter are found in the detailed description and appended claims. Other aspects will be apparent to persons skilled in the art upon reading and understanding the following detailed description and viewing the drawings that form a part thereof, each of which are not to be taken in a limiting sense. The scope of the present invention is defined by the appended claims and their legal equivalents.

DETAILED DESCRIPTION

The following detailed description of the present subject matter refers to subject matter in the accompanying drawings which show, by way of illustration, specific aspects and examples in which the present subject matter may be practiced. These examples are described in sufficient detail to enable those skilled in the art to practice the present subject matter. References to "an", "one", or "various" examples in this disclosure are not necessarily to the same example, and such references contemplate more than one example. The following detailed description is demonstrative and not to be taken in a limiting sense. The scope of the present subject matter is defined by the appended claims, along with the full scope of legal equivalents to which such claims are entitled.

The present detailed description will discuss hearing assistance devices using the example of hearing aids. Hearing aids are only one type of hearing assistance device. Other hearing assistance devices include, but are not limited to, those in this document. Hearing assistance devices include, but are not limited, ear level devices that provide hearing benefit. One example is a device for treating tinnitus. Another example is an ear protection device. Possible examples include devices that can combine one or more of the functions/examples provided herein. It is understood that their use in the description is intended to demonstrate the present subject matter, but not in a limited or exclusive or exhaustive sense.

Figure 1:
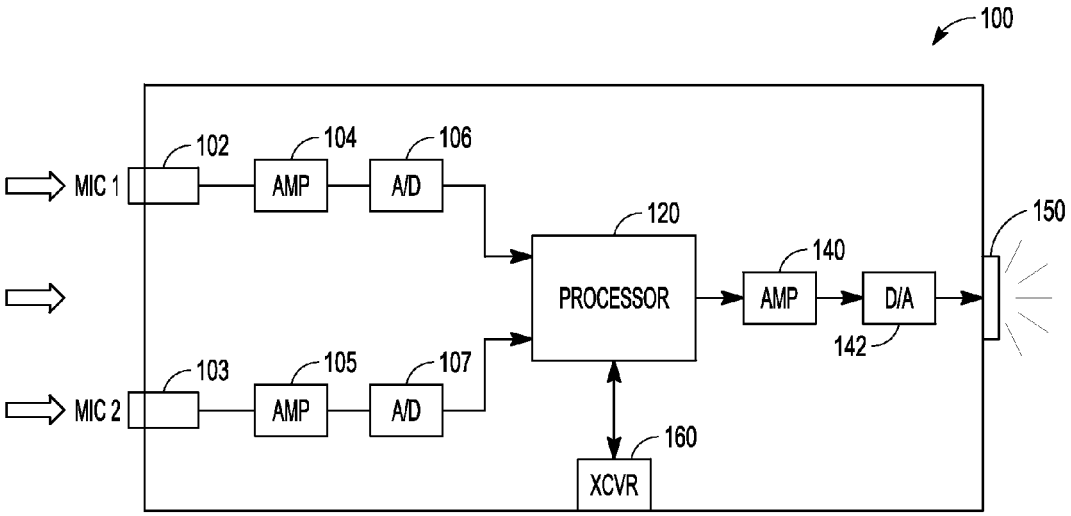
FIG. 1 is a block diagram of a hearing assistance device, according to one embodiment of this disclosure.

FIG. 1 shows a block diagram of an example of a hearing assistance device in accordance with this disclosure. In one example, hearing assistance device 100 is a hearing aid. In one example, mic 1 102 is an omnidirectional microphone connected to amplifier 104 that provides signals to analog-to-digital converter 106 ("A/D converter"). The sampled signals are sent to processor 120 that processes the digital samples and provides them to amplifier 140. The amplified digital signals are then converted to analog by the digital-to-analog converter 142 ("D/A converter"). The receiver 150 (also known as a speaker) can demodulate and play a digital signal directly, or it can play analog audio signals received from the D/A converter 142. In various embodiments, the digital signal is amplified and a pulse-density modulated signal is sent to the receiver, which demodulates it, thereby extracting the analog signal. Although FIG. 1 shows D/A converter 142 and amplifier 140 and receiver 150, it is understood that other outputs of the digital information may be provided. For instance, in one example implementation, the digital data is sent to another device configured to receive it. For example, the data may be sent as streaming packets to another device that is compatible with packetized communications. In one example, the digital output is transmitted via digital radio transmissions. In one example, the digital radio transmissions are packetized and adapted to be compatible with a standard. Thus, the present subject matter is demonstrated, but not intended to be limited, by the arrangement of FIG. 1.

In one example, mic 2 103 is a directional microphone connected to amplifier 105 that provides signals to analog-to-digital converter 107 ("A/D converter"). The samples from A/D converter 107 are received by processor 120 for processing. In one example, mic 2 103 is another omnidirectional microphone. In such examples, directionality is controllable via phasing mic 1 and mic 2. In one example, mic 1 is a directional microphone with an omnidirectional setting. In one example, the gain on mic 2 is reduced so that the system 100 is effectively a single microphone system. In one example, (not shown) system 100 only has one microphone. Other variations are possible that are within the principles set forth herein.

Hearing assistance device 100 can further include transceiver 160 that includes circuitry configured to wirelessly transmit and receive information. Transceiver 160 can establish a wireless communication link and transmit or receive information from another hearing assistance device 100 and/or from an on-the-body device and/or an off-the-body device, e.g., a mobile communication device, such as a mobile phone or a microphone accessory.

In accordance with various techniques of this disclosure and as described in more detail below, processor 120 includes modules for execution that can classify a sound environment and determine an environmental classification uncertainty value, which can be compared, e.g., using an error matrix and error distribution, to a received environmental classification uncertainty value from another hearing assistance device 100 and/or from an on-the-body device and/or an off-the-body device in order to determine a consensus for environmental classification between left and right hearing assistance devices and/or from an on-the-body device and/or an off-the-body device. An example of an on-the-body device includes a microphone on-the-body connected to a one-way wireless transmitter for communicating ambient sound environment to the hearing assistance device(s).

Figure 2:
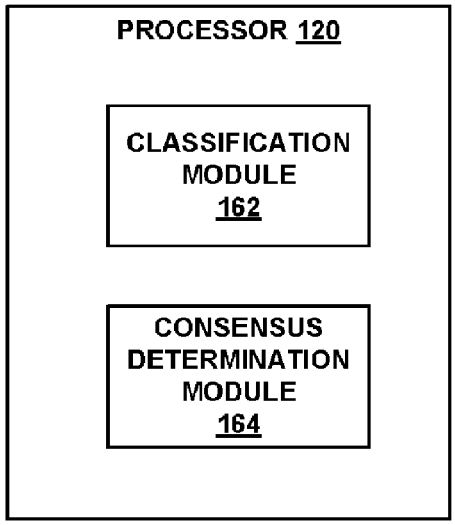
FIG. 2 is a block diagram illustrating an embodiment of a processor in a hearing assistance device that can be used to implement various techniques of this disclosure.

FIG. 2 is a block diagram illustrating an example of a processor that can be used to implement various techniques of this disclosure. In particular, FIG. 2 depicts processor 120 of FIG. 1 including two modules, namely sound classification module 162 and consensus determination module 164, that can be used to for classifying a sound environment. Sound classification module 162 can extract a set of features from the signals received by mic 1 102 and/or mic 2 103 (both of FIG. 1) to classify the sound environment of hearing assistance device 100. In some examples, the feature sets can overlap.

In one example, sound classification module 162 uses a two-stage environment classification scheme. The signals mic 1 102 and/or mic 2 103 can be first classified as music, speech or non-speech. The non-speech sounds can be further characterized as machine noise, wind noise or other sounds. At each stage, the classification performance and the associated computational cost are evaluated along three dimensions: the choice of classifiers, the choice of feature sets and number of features within each feature set.

Choosing appropriate features to be implemented in the sound classification module may be a domain-specific question. The sound classification module 162 can include one of two feature groups, specifically a low level feature set, and Mel-scale Frequency cepstral coefficients (MFCC). The former can include both temporal and spectral features, such as zero crossing rate, short time energy, spectral centroid, spectral bandwidth, spectral roll-off, spectral flux, high/low energy ratio, etc. The logarithms of these features can be included in the set as well. The first 12 coefficients can be included in the MFCC set. Other features can include cepstral modulation ratio and several psychoacoustic features.

Within each set, some features may be redundant or noisy or simply have weak discriminative capability. To identify optimal features, a forward sequential feature selection algorithm can be employed. Additional information regarding an example of a sound classification technique is described in U.S. patent application Ser. No. 12/879,218, titled "SOUND CLASSIFICATION SYSTEM FOR HEARING AIDS," by Juanjuan Xiang et al., and filed on Sep. 10, 2010, the entire contents of which being incorporated herein by reference.

In some examples, upon determining a sound classification of the received signal(s), sound classification module 162 of processor 120 can further determine a sound classification uncertainty value. In one example, an error matrix and error distributions can be measured, e.g., during training of a hearing assistance devices, and stored in a memory device (not depicted) in hearing assistance device 100. Following sound classification, sound classification module 162 can calculate a sound classification uncertainty value by comparing the actual results of the sound classification to the error matrix and error distributions stored on the memory device.

According to various embodiments, upon determining the sound classification uncertainty value, processor 120 can control transceiver 160 to transmit the determined sound classification to another hearing assistance device 100. For example, processor 120 can control transceiver 160 of a first hearing assistance device 100, e.g., a hearing aid for a left ear, to transmit a sound classification determined by classification module 162 to a second hearing assistance device 100, e.g., a hearing aid of a right ear. Similarly, processor 120 of the second hearing assistance device 100 can its control transceiver 160 to transmit a sound classification determined by its classification module 162 to the first hearing assistance device 100, in various embodiments. In this manner, both first and second hearing assistance devices, e.g., left and right hearing aids, determine and exchange sound classifications.

Upon receiving a sound classification transmitted by the first hearing assistance device 100, transceiver 160 of the second hearing assistance device 100 outputs a signal representative of the sound classification to processor 120. Processor 120 and, in particular, consensus determination module 164 of the second hearing assistance device, can execute instructions that compare the received sound classification from the first hearing assistance device 100 to its own determined sound classification.

Similarly, upon receiving a sound classification transmitted by the second hearing assistance device 100, transceiver 160 of the first hearing assistance device 100 outputs a signal representative of the sound classification to processor 120. Processor 120 and, in particular, consensus determination module 164 of the first hearing assistance device, can execute instructions that compare the received sound classification from the second hearing assistance device 100 to its own determined sound classification. In this manner and in accordance with this disclosure, a binaural consensus between the two hearing assistance devices can be used in order to select an environmental classification of the sound environment.

If, upon comparison, consensus determination module 164 of either the first hearing assistance device or the second hearing assistance device determines that the received sound classification and the determined sound classification agree with one another, a binaural consensus between the two hearing assistance devices has been reached, in various embodiments. As such, each processor 120 of the respective hearing assistance device can apply parameter settings appropriate for the classified sound environment to improve the user's listening experience.

However, if, upon comparison, consensus determination module 164 of either the first hearing assistance device or the second hearing assistance device determines that the received sound classification and the determined sound classification do not agree with one another, a binaural consensus between the two hearing assistance devices has not been reached and, in accordance with this disclosure, additional steps can be taken to resolve the disagreement. In one example implementation, consensus determination module 164 of either the first hearing assistance device or the second hearing assistance device can compare determined sound classification uncertainty values. Like the sound classifications, each hearing assistance device 100 can transmit and receive determined sound classification uncertainty values. In some examples, processor 120 can transmit a determined sound classification uncertainty value along with the transmission of the determined sound classification. In other examples, processor 120 can transmit a determined sound classification uncertainty value upon consensus determination module 164 determining that a discrepancy exists following a comparison between a received sound classification and a determined sound classification.

Consensus determination module 164 of the first hearing assistance device 100 can receive the sound classification uncertainty value determined by the second hearing assistance device 100. Then, consensus determination module 164 of the first hearing assistance device 100 can compare the two sound classification uncertainty values and select the sound classification having the lower uncertainty value. Similarly, consensus determination module 164 of the second hearing assistance device 100 can receive the sound classification uncertainty value determined by the first hearing assistance device 100. Then, consensus determination module 164 of the second hearing assistance device 100 can compare the two sound classification uncertainty values and select the sound classification having the lower uncertainty value, in various embodiments.

In some example implementations, one of the first hearing assistance device and the second hearing assistance device can act as a master device in determining the sound classification. That is, rather than both the first hearing assistance device and the second hearing assistance device comparing sound classification uncertainty values, only one of the two hearing assistance devices compares sound classification uncertainty values to make a final decision regarding sound classification. In such an implementation, the master device, can transmit the final sound classification determination to the other device, e.g., another hearing assistance device, an on-the-body sensor, and/or an off-the-body sensor.

In accordance with this disclosure, an on-the-body device and/or an off-the-body device, e.g., a mobile communication device, such as a mobile phone or a microphone accessory, can also be used to classify the sound environment, as described in more detail below with respect to FIG. 3. Additional separate sets of overlapping features can be used by the on-the-body or off-the-body device to classify the sound environment. Using multiple devices to classify the sound environment can allow more features to be used in the classification, thereby improving the accuracy of the classification.

Figure 3:
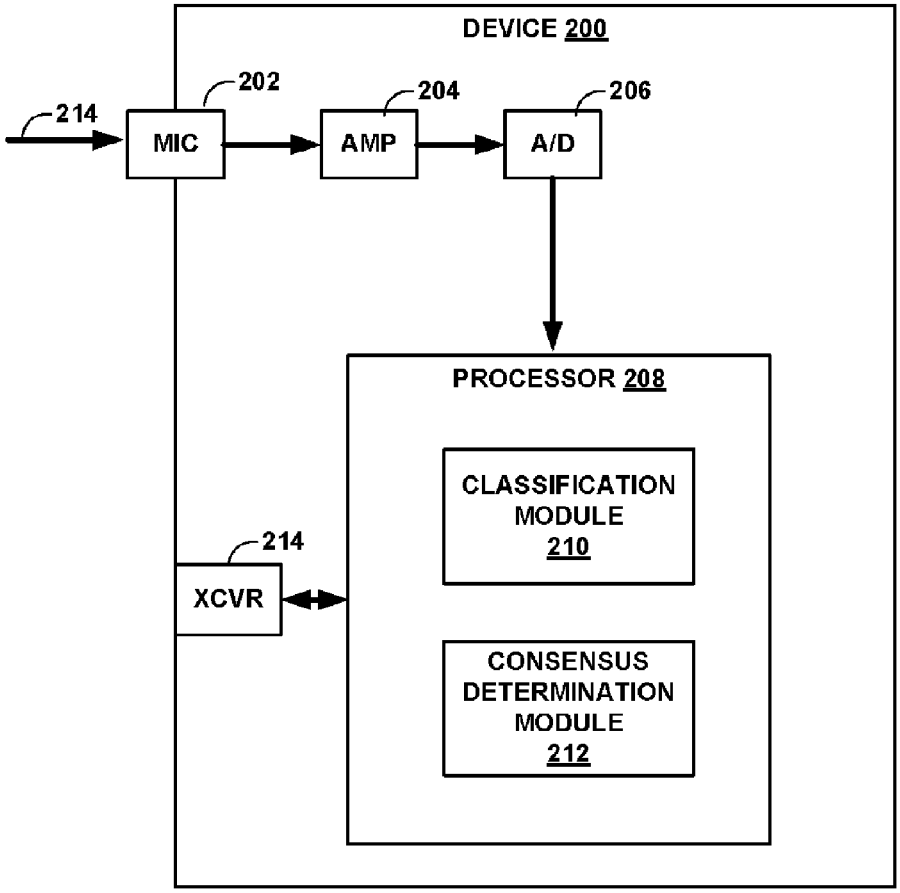
FIG. 3 is a block diagram illustrating an embodiment of a device that can be used to implement various techniques of this disclosure.

FIG. 3 is a block diagram illustrating an example of a device that can be used to implement various techniques of this disclosure. In FIG. 3, device 200 can be an on-the-body device or an off-the-body device, e.g., a mobile communication device, such as a mobile phone or a microphone accessory. In various embodiments, device 200 includes an omnidirectional or directional microphone system, amplifier, A/D converter and wireless transmitter with processor 208 in the hearing devices. Device 200 can include a microphone 202, e.g., an omnidirectional microphone, and an amplifier 204 that provides signals to analog-to-digital converter 206 ("A/D converter"). The sampled signals are sent to processor 208 that processes the digital samples. According to various embodiments, processor 208 includes two modules, namely sound classification module 210 and consensus determination module 212, that can be used to for classifying a sound environment. Sound classification module 210 and consensus determination module 212 are similar to sound classification module 162 and consensus determination module 164 of FIG. 2 and, for purposes of conciseness, will not be described in detail again. Upon receiving a signal 214 via microphone 202, device 200 and, in particular, sound classification module 210 and consensus determination module 212 of processor 208, can determine a sound classification and a sound classification uncertainty value in a manner similar to that described above with respect to processor 120 of FIG. 2, which, for purposes of conciseness, will not be described in detail again. In one embodiment, the final sound classification can also be determined in the on- or off-body device, e.g. cell phone, having a two-way transceiver to receive classification and uncertainty data from hearing assistance devices and/or other on- or off-the-body devices.

According to various embodiments, device 200 further includes transceiver 214 that includes circuitry configured to wirelessly transmit and receive information. Transceiver 214 can establish a wireless communication link and transmit or receive information to one or more hearing assistance devices 100 and/or an on-the-body device or an off-the-body device. In particular, transceiver 214 can transmit to at least one device, e.g., one or more hearing assistance devices 100, a determined sound classification and a determined sound classification uncertainty value that can be used to form a final decision of the sound environment.

Figure 4A:
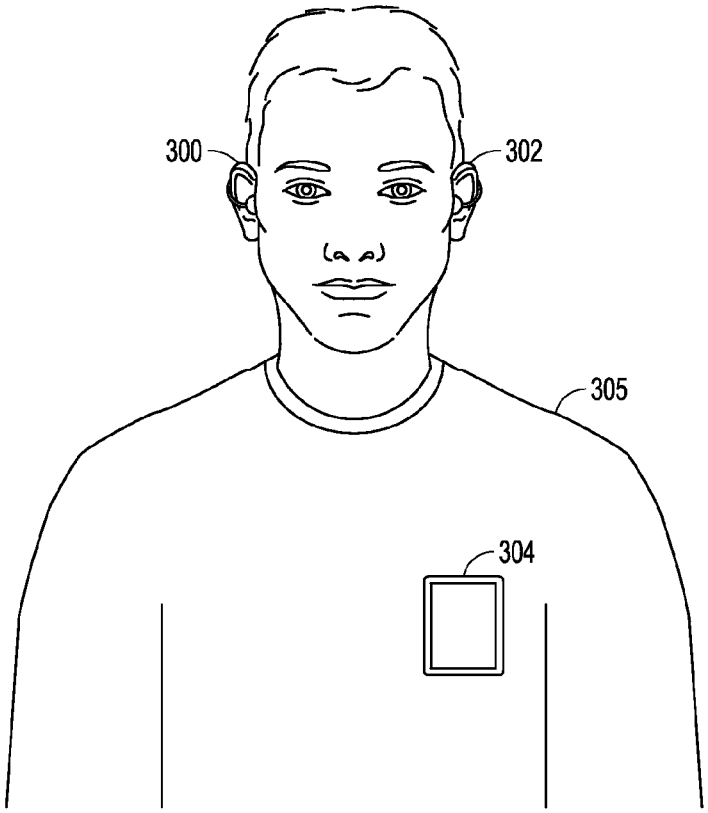
FIGS. 4A and 4B are example configurations that can be used to implement various embodiments of this disclosure.
Figure 4B:
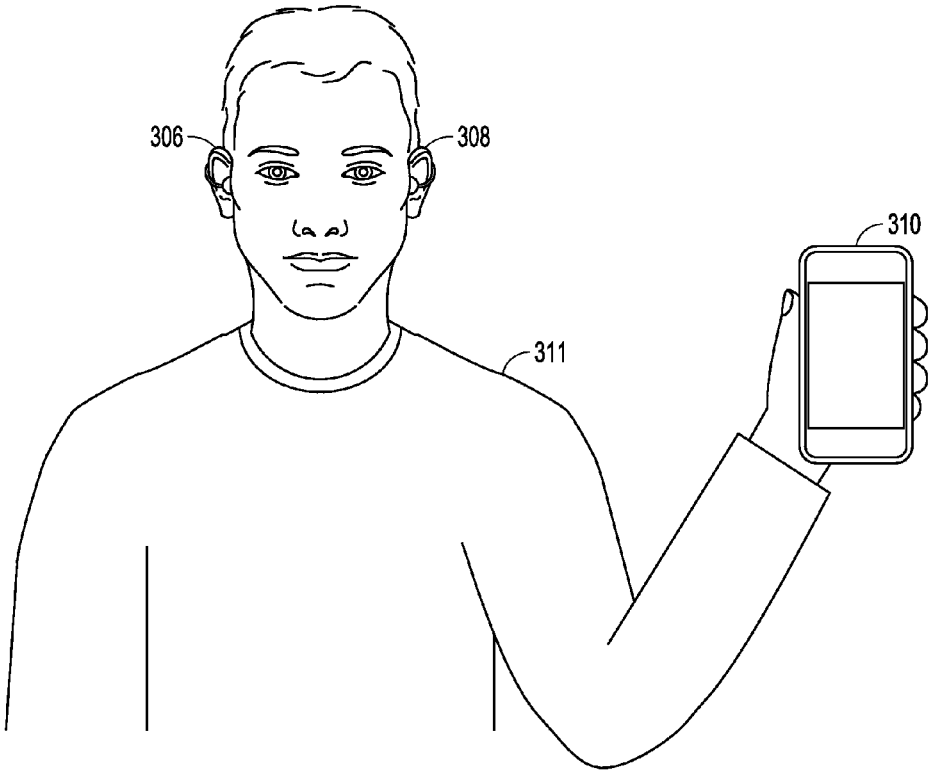

FIGS. 4A and 4B are example configurations that can be used to implement various techniques of this disclosure. In particular, FIG. 4A depicts a first hearing assistance device 300, a second hearing device 302, and an on-the-body device 304 in wireless communication with each other and configured to classify a sound environment by consensus. FIG. 4B depicts a first hearing assistance device 306, a second hearing device 308, and an off-the-body device 310 in wireless communication with each other and configured to classify a sound environment by consensus.

Referring to FIG. 4A and by way of specific example, first hearing assistance device 300 can receive a sound classification determined by second hearing assistance device 302 and another sound classification determined by at least one other device, e.g., on-the-body 304. On-the-body device 304, e.g., a microphone with a wireless transmitter, can be attached to a shirt of a person 305, for example. An example of on-the-body device 304 was described above with respect to device 200 of FIG. 3 and, for purposes of conciseness, will not be described in detail again. Using the techniques described above, consensus determination module 164 of the first hearing assistance device 300 can compare the received sound classifications from the second hearing assistance device 302 and one or more devices 304.

If, upon comparison, consensus determination module 164 of the first hearing assistance device 300 determines that the received sound classifications and its determined sound classification agree with each another, a consensus between the two hearing assistance devices 300, 302 and the other device 304 has been reached. As such, each processor 120 of the respective hearing assistance device 300, 302 can apply parameter settings appropriate for the classified sound environment to improve the user's listening experience.

However, if, upon comparison, consensus determination module 164 of the first hearing assistance device 300 determines that the received sound classifications and the determined sound classification do not agree with each another, a consensus between the devices has not been reached and, in accordance with this disclosure, additional steps can be taken to resolve the disagreement. In one example implementation, consensus determination module 164 of the first hearing assistance device 300 can compare the sound classification uncertainty value that it determined to sound classification uncertainty values determined by and received from the second hearing assistance device 302 and the other device 304. Then, consensus determination module 164 of the second hearing assistance device 302 can compare the three sound classification uncertainty values, select the sound classification having the lower uncertainty value, and apply parameter settings appropriate for the classified sound environment.

In some examples, processor 120 of hearing assistance devices 300, 302 can wait to control transmission of any data regarding sound classification until after classification module 162 determines that a change in environment has occurred. After classification module 162 determines that a change in environment has occurred, processor 120 can generate a packet for transmission by adding the payload bits representing the classification results determined by classification module 162, adding destination information of another hearing assistance device 100 and/or another device 304 to a destination field, and adding appropriate headers and trailers.

In examples implementations that simply exchange classification results between devices, the transmissions can be 1-way and asynchronous. In such examples, the wireless data rate can be low, e.g., 128 kilo bits per second, and can have a radio wake-up time of about 250 milliseconds, for example. In examples implementations that use one device as a master device to form a classification consensus, the wireless data rate can be low, e.g., 64 kilo bits per second, and can have a transmit-receive turn-around time of about 1.6 milliseconds, for example.

As indicated above, FIG. 4B depicts a first hearing assistance device 306, a second hearing device 308, and an off-the-body device 310 in wireless communication with each other and configured to classify a sound environment by consensus. An example of the off-the-body device 310, e.g., a mobile communication device, such as a mobile phone or a microphone accessory, was described above with respect to device 200 of FIG. 3 and, for purposes of conciseness, will not be described in detail again. In the example configuration depicted in FIG. 4B, the person 311 is holding the off-the-body device 310 but, in other configurations, the off-the-body device 310 may not be in contact with the person 311.

The interaction between the hearing assistance device 306, the second hearing device 308, and the off-the-body device 310 shown in FIG. 4B is substantially similar to the techniques described above with respect to FIG. 4A between the first hearing assistance device 300, the second hearing device 302, and the on-the-body 304. Hence, in the interest of brevity and to avoid redundancy, the interaction between the hearing assistance device 306, the second hearing device 308, and the off-the-body device 310 shown in FIG. 4B will not be described again.

Figure 5:
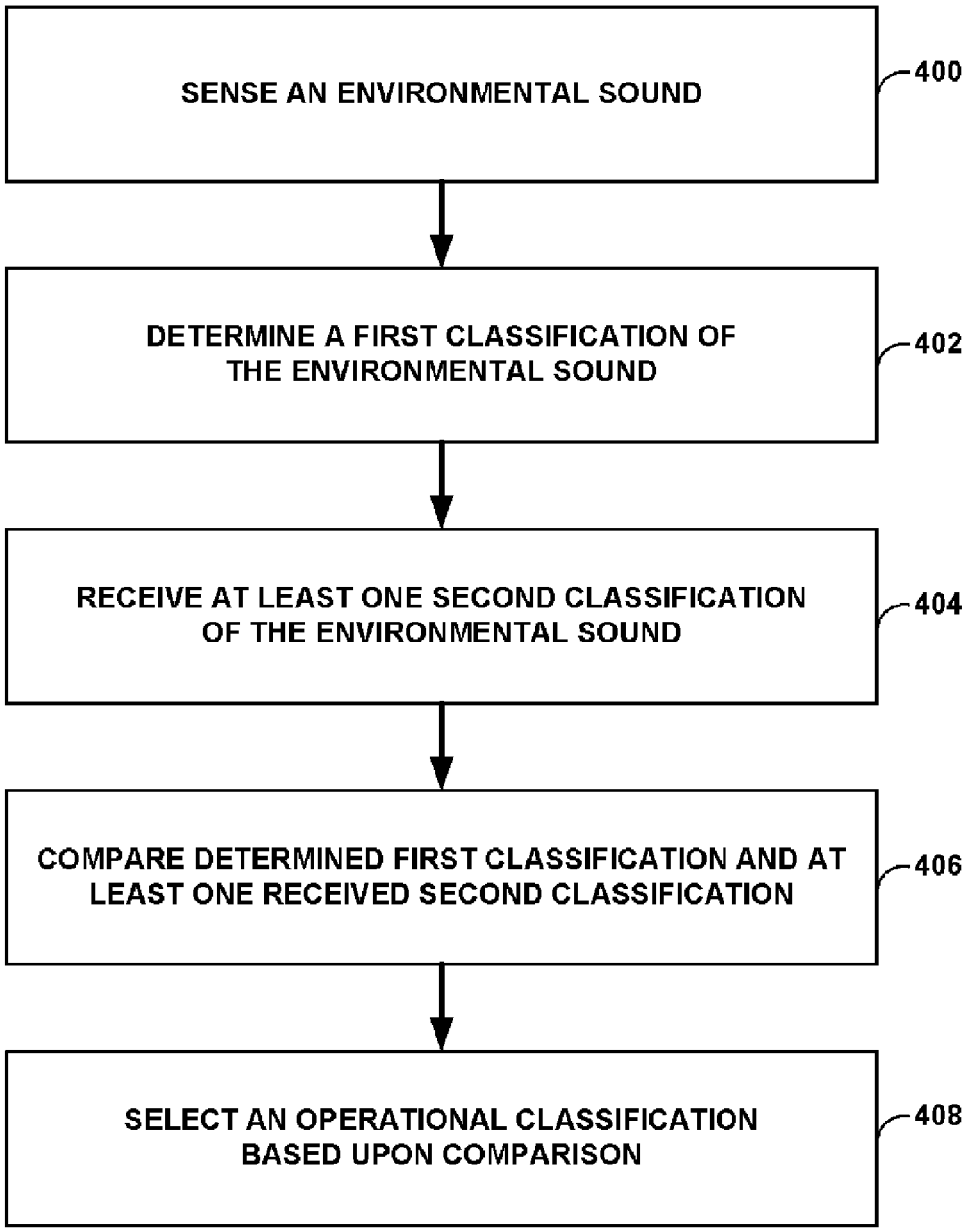
FIG. 5 is a flow diagram illustrating an embodiment of a method for selecting a classification of a sound environment of a hearing assistance device in accordance with this disclosure.

FIG. 5 is a flow diagram illustrating an example of a method for selecting a classification of a sound environment of a hearing assistance device in accordance with this disclosure. In the example method shown in FIG. 5, a first hearing assistance device, e.g., hearing assistance device 100 of FIG. 1, senses an environmental sound, e.g., via mic 1 102 (400). Amplifier 104 and A/D converter 106 transmit a signal representing the sensed environmental sound to processor 120. Processor 120 and, in particular, classification module 162, determines a first classification of the environmental sound, e.g., music, speech, non-speech, and the like (402). First hearing assistance device 100 receives, via transceiver 160, a second classification of the environmental sound from a second hearing assistance device (404). In some examples, in addition to a second classification received from a second hearing assistance device, first hearing assistance device 100 also receives, via transceiver 160, a second classification of the environmental sound from on-the-body device and/or an off-the-body device, e.g., a mobile communication device, such as a mobile phone or a microphone accessory. Upon receiving one or more second classifications, the first hearing assistance device and, more particularly, consensus determination module 164 of processor 120, compares the determined first classification and the received second classification(s) (406) and selects an operational classification for the first hearing assistance device based upon the comparison (408). Processor 120 can then apply parameter settings appropriate for the selected operational classification to improve the user's listening experience.

It is further understood that any hearing assistance device may be used without departing from the scope and the devices depicted in the figures are intended to demonstrate the subject matter, but not in a limited, exhaustive, or exclusive sense. It is also understood that the present subject matter can be used with a device designed for use in the right ear or the left ear or both ears of the wearer.

It is understood that the hearing aids and accessories referenced in this patent application include a processor. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, and certain types of filtering and processing. In various embodiments the processor is adapted to perform instructions stored in memory which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A method for operating a hearing assistance device, the method comprising:

sensing an environmental sound;

determining a first classification of the environmental sound;

determining a first sound classification uncertainty value of the environmental sound;

receiving at least one second classification of the environmental sound;

receiving at least one second sound classification uncertainty value of the environmental sound;

comparing the determined first classification and the at least one received second classification;

when the determined first classification is not the same as the at least one received second classification, comparing the determined first sound classification uncertainty value and the at least one second sound classification uncertainty value; and selecting an operational classification for the hearing assistance device based upon the lowest of the compared uncertainty values.

2. The method of claim 1, comprising:

when the determined first classification is the same as the at least one received second classification, selecting an operational classification to be the determined first classification.

3. The method of claim 1, further comprising applying parameter settings for the hearing assistance device appropriate for the selected operational classification.

4. The method of claim 1, wherein sensing an environmental sound includes using a microphone.

5. The method of claim 1, wherein receiving at least one second classification of the environmental sound includes receiving the at least one second classification from a second hearing assistance device.

6. A system comprising:

a first hearing assistance device comprising:

a microphone configured to sense an environmental sound;

a transceiver configured to receive at least one second classification of the environmental sound and at least one second sound classification uncertainty value of the environmental sound; and a processor including:

a classification module configured to determine a first classification of the sensed environmental sound and a first sound classification uncertainty value of the sensed environmental sound; and a consensus determination module configured to:

compare the determined first classification and the at least one received second classification, and, when the determined classification is the same as the at least one received second classification, to select an operational classification for the hearing assistance device based upon the comparison; and compare the determined first sound classification uncertainty value and the at least one received second sound classification uncertainty value when the determined first classification is not the same as the at least one received second classification, and to select an operational classification for the hearing assistance device based upon the lowest of the compared uncertainty values.

7. The system of claim 6, further comprising:

a second hearing assistance device, comprising:

a device microphone configured to sense the environmental sound;

a device processor including a device classification module configured to determine the at least one second classification of the sensed environmental sound; and a transceiver configured to send the at least one second classification of the environmental sound to the first hearing assistance device.

8. The system of claim 7, wherein the second hearing assistance device further comprises a device consensus determination module.

9. The system of claim 6, further comprising:

an on-the-body device, comprising:

a device microphone configured to sense the environmental sound;

a device processor including a device classification module configured to determine the at least one second classification of the sensed environmental sound; and a transceiver configured to send the at least one second classification of the environmental sound to the first hearing assistance device.

10. The system of claim 6, further comprising:

an off-the-body device, comprising:

a device microphone configured to sense the environmental sound;

a device processor including a device classification module configured to determine the at least one second classification of the sensed environmental sound; and a transceiver configured to send the at least one second classification of the environmental sound to the first hearing assistance device.

11. The system of claim 10, wherein the off-the-body device includes a mobile phone.

12. The system of claim 6, wherein the first hearing assistance device includes a hearing aid.

13. The system of claim 12, wherein the hearing aid includes an in-the-ear (ITE) hearing aid.

14. The system of claim 12, wherein the hearing aid includes a behind-the-ear (BTE) hearing aid.

15. The system of claim 12, wherein the hearing aid includes an in-the-canal (ITC) hearing aid.

16. The system of claim 12, wherein the hearing aid includes a receiver-in-canal (RIC) hearing aid.

17. The system of claim 12, wherein the hearing aid includes a completely-in-the-canal (CIC) hearing aid.

18. The system of claim 12, wherein the hearing aid includes a receiver-in-the-ear (RITE) hearing aid.

* * * * *